US011759920B2

(12) United States Patent
Terry, Jr.

(10) Patent No.: US 11,759,920 B2
(45) **Date of Patent: *Sep. 19, 2023**

(54) DUAL RATCHETING HAND TOOL AND METHODS OF USE

(71) Applicant: Split Ratchet, LLC, Atlanta, GA (US)

(72) Inventor: Dennis Blaine Terry, Jr., Altanta, GA (US)

(73) Assignee: SPLIT RATCHET, LLC, Atlanta, GA (US)

( * ) Notice: Subject to any disclaimer, the term of this patent is extended or adjusted under 35 U.S.C. 154(b) by 110 days.

This patent is subject to a terminal disclaimer.

(21) Appl. No.: 17/341,911

(22) Filed: Jun. 8, 2021

(65) Prior Publication Data

US 2021/0291326 A1 Sep. 23, 2021

Related U.S. Application Data

(63) Continuation of application No. 17/149,126, filed on Jan. 14, 2021, now Pat. No. 11,040,433.

(60) Provisional application No. 62/961,394, filed on Jan. 15, 2020.

(51) Int. Cl.

| | |
|---|---|
| ***B25B 13/46*** | (2006.01) |
| ***B25B 13/06*** | (2006.01) |
| ***B25G 1/00*** | (2006.01) |
| ***B25G 1/04*** | (2006.01) |

(52) U.S. Cl.

CPC ..... *B25B 13/467* (2013.01); *B25B 13/065* (2013.01); *B25B 13/463* (2013.01); *B25G 1/005* (2013.01); *B25G 1/043* (2013.01)

(58) Field of Classification Search

CPC ... B25B 13/065; B25B 13/463; B25B 13/467; B25G 1/005; B25G 1/043

See application file for complete search history.

(56) References Cited

U.S. PATENT DOCUMENTS

| | | | |
|---|---|---|---|
| 755,569 | A | 3/1904 | Freeland |
| 1,601,767 | A | 10/1926 | Peterson |
| 1,860,914 | A | 5/1932 | Wellman |
| 1,957,462 | A | 5/1934 | Kress |

(Continued)

OTHER PUBLICATIONS

International Search Report dated Apr. 21, 2021 of corresponding International Patent Application No. PCT/US21/13436.

*Primary Examiner* — David B. Thomas

(74) *Attorney, Agent, or Firm* — Jessica Zurlo; Stephen H. Hall; Bradley Arant Boult Cummings LLP

(57) ABSTRACT

A dual ratcheting tool having multiple ratchet assemblies and handles for rotating adapters, sockets, and other tools is provided. The dual ratcheting tool includes an upper ratchet assembly independently rotationally and mechanically connected to a lower ratchet assembly; a drive member connected to the upper ratchet assembly and the lower ratchet assembly; an upper handle connected to the upper ratchet assembly, the upper handle having an upper directional switch to set a drive direction of the upper ratchet assembly; and a lower handle connected to the lower ratchet assembly, the lower handle having a lower directional switch to set a drive direction of the lower ratchet assembly. The upper and lower handles of the dual ratcheting tool can independently and in combination can drive a socket more quickly and efficiently than ratchets having a single ratchet assembly and handle.

14 Claims, 17 Drawing Sheets

(56) References Cited

U.S. PATENT DOCUMENTS

| | | | | |
|---|---|---|---|---|
| 2,520,443 | A | 8/1950 | Seaquist | |
| 2,558,897 | A | 7/1951 | Akins | |
| 2,641,136 | A | 6/1953 | Marsden, Jr. et al. | |
| 2,982,160 | A | 5/1961 | Little | |
| 3,180,185 | A | 4/1965 | Schmidt et al. | |
| 3,337,014 | A | 8/1967 | Sandrick | |
| 3,575,069 | A | 4/1971 | White | |
| 3,577,816 | A | 5/1971 | Alexander et al. | |
| 3,587,364 | A | 6/1971 | Peyre | |
| 3,828,629 | A | 4/1974 | Moore | |
| 3,957,096 | A | 5/1976 | Rodman | |
| 3,983,759 | A | 10/1976 | Linden | |
| 4,366,731 | A | 1/1983 | Vallevand | |
| 4,426,895 | A | 1/1984 | Lack | |
| 4,507,990 | A | 4/1985 | Lack | |
| 4,546,676 | A | 10/1985 | Kiefer, Jr. | |
| 5,152,196 | A | 10/1992 | Garrett | |
| 5,568,757 | A | 10/1996 | Lewis | |
| 5,775,182 | A | 7/1998 | Plakinger | |
| 6,401,573 | B2 | 6/2002 | McClure | |
| 6,427,560 | B1 | 8/2002 | Shea | |
| 6,474,200 | B2 | 11/2002 | Lai Lee | |
| 6,681,660 | B2 | 1/2004 | Foard | |
| 7,040,197 | B2 | 5/2006 | Wu | |
| 8,353,229 | B1 | 1/2013 | Muhareb | |
| 9,522,459 | B2 | 12/2016 | Cook | |
| 9,687,969 | B2 | 6/2017 | Wang | |
| 2006/0102442 | A1* | 5/2006 | Dein | B25B 13/462 192/44 |
| 2006/0288821 | A1 | 12/2006 | Girard | |

* cited by examiner

DUAL RATCHETING HAND TOOL AND METHODS OF USE

CROSS REFERENCE TO RELATED APPLICATION

This application is a continuation of U.S. application Ser. No. 17/149,126, filed on Jan. 14, 2021, which claims the benefit of and priority to U.S. Provisional Application No. 62/961,394, filed on Jan. 15, 2020, and entitled "Dual Ratcheting Hand Tool and Methods of Use," each of which is incorporated by reference herein in its entirety.

FIELD OF THE DISCLOSURE

The present disclosure relates generally to hand tools, and more particularly to a dual handled ratcheting tool.

BACKGROUND

Ratchet wrenches, or ratchets as they are commonly referred to, have been available for many years as a convenient hand tool. A ratchet wrench is an essential tool that is used to fasten or loosen nuts and bolts. Improvements to the basic ratchet wrench have been developed, including, for instance, reversing mechanisms which will allow the ratchet to tighten in one direction and freely rotate in the other, spinners to advance the ratchet mechanism until it is finger tight about the work piece, remote reversal mechanisms, and pneumatic or electrically assisted socket spinners.

Despite these improvements, the ratchet wrenches currently on the market present challenges and disadvantages. For instance, one of the problems experienced by mechanics and others using ratchet wrenches is the ability to manipulate the hand tool when operating in a confined area. Often times the ratchet wrench is being used in a restricted area with limited movement available to the wrench, which makes it difficult to efficiently drive fasteners, such as nuts and bolts. In addition, the ratchet wrenches currently available operate using a single handle. While the single handle allows for the ratchet to tighten or loosen the fastener, it could save time for the user if there was a faster and more efficient ratcheting mechanism with an ability to increase torque.

Accordingly, there remains a need in the art for an improved ratchet wrench that can be used in confined spaces and allows for faster and more efficient driving of the ratchet and increased applied torque.

SUMMARY

In some embodiments, the present disclosure provides a dual ratcheting tool, the dual ratcheting tool including a stacked ratchet assembly, the stacked ratchet assembly including an upper ratchet assembly independently rotationally and mechanically connected to a lower ratchet assembly; a drive member operatively connected to the upper ratchet assembly and the lower ratchet assembly, wherein the drive member further includes a spring-loaded ball configured for receiving an attachment; an upper handle connected to the upper ratchet assembly, the upper handle having an upper directional switch to set or lock a drive direction of the upper ratchet assembly; a lower handle connected to the lower ratchet assembly, the lower handle having a lower directional switch to set or lock a drive direction of the lower ratchet assembly; wherein the upper handle and the lower handle independently and in combination drive the attachment.

In one embodiment, a plunger may be slidably positioned therethrough the stacked ratchet assembly and configured to release the spring-loaded ball holding the attachment to the drive member. In another embodiment, the upper ratchet assembly further includes an upper gear drive configured for rotation by the upper handle and the lower ratchet assembly further includes a lower gear drive configured for rotation by the lower handle. In still another embodiment, the upper gear drive and the lower gear drive each include a plurality of gear teeth configured for engagement with a pair of pawls. In yet another embodiment, each of the pair of pawls are operatively connected to a spring, the spring configured to move the pawls into engagement with the gear teeth when the drive direction is set. In another embodiment, the drive member is a chamfered square drive.

In other embodiments, the present disclosure provides a dual ratcheting tool, the dual ratcheting tool including a stacked ratchet assembly, the stacked ratchet assembly including an upper ratchet assembly independently rotationally and mechanically connected to a lower ratchet assembly; a drive member operatively connected to the upper ratchet assembly and the lower ratchet assembly, wherein the drive member further includes a spring-loaded ball configured for retaining an attachment, such as a socket or adapter, thereto; an upper handle connected to the upper ratchet assembly, the upper handle having an upper directional switch to set or lock a drive direction of the upper ratchet assembly; a lower handle connected to the lower ratchet assembly, the lower handle having a lower directional switch to set or lock a drive direction of the lower ratchet assembly; a plunger slidably positioned through the stacked ratchet assembly having a first end extending from the upper ratchet assembly and a second end positioned through the lower ratchet assembly and said drive member, wherein the plunger is configured to release the spring-loaded ball holding the attachment thereto; and wherein the upper handle and the lower handle independently and in combination drive the attachment.

In one embodiment, the upper directional switch and the lower directional switch are configured to slide horizontally to set each of the drive directions. In another embodiment, the upper directional switch and the lower directional switch are further configured to set a locking position in which the rotational movement of the upper handle, the lower handle, or both the upper handle and the lower handle is locked. In still another embodiment, the first end of the plunger includes a button operable to release the spring-loaded ball. In yet another embodiment, the upper handle and the lower handle are each rotatable 360 degrees about a vertical axis of the stacked ratchet assembly. In another embodiment, the upper directional switch is positioned adjacent to and directly above the lower directional switch.

In still other embodiments, the present disclosure provides a torque wrench, the torque wrench including a torque wrench assembly having a top plate, a middle plate disposed thereunder, a spring disposed in between the middle plate and a bottom plate, wherein the bottom plate is configured for engagement with an upper gear drive and a lower gear drive, and wherein the top plate, the middle plate, the spring, the bottom plate, and the upper and lower gear drives are operatively attached to a shaft; a drive member operatively connected to the shaft, wherein the drive member further includes a spring-loaded ball configured for retaining an attachment thereto; an upper handle connected to the torque wrench assembly, the upper handle having an upper directional switch to set or lock a drive direction of the upper gear drive; a lower handle connected to the torque wrench assembly, the lower handle having a lower directional switch to set or lock a drive direction of the lower gear drive; wherein the upper handle and the lower handle independently and in combination drive the attachment.

In one embodiment, the middle plate includes a plurality of torque settings. In another embodiment, the upper gear drive and the lower gear drive include bevel gears, concentric gears, interlocking gears, or combinations thereof. In still another embodiment, the top plate includes a threaded opening configured for coupling to a corresponding threaded portion on the shaft. In yet another embodiment, the bottom plate includes a plurality of roller bearings configured for engagement with a plurality of corresponding roller seats disposed on the upper gear drive.

BRIEF DESCRIPTION OF THE DRAWINGS

Further features and advantages can be ascertained from the following detailed description that is provided in connection with the drawings described below.

DETAILED DESCRIPTION

Figure 1:
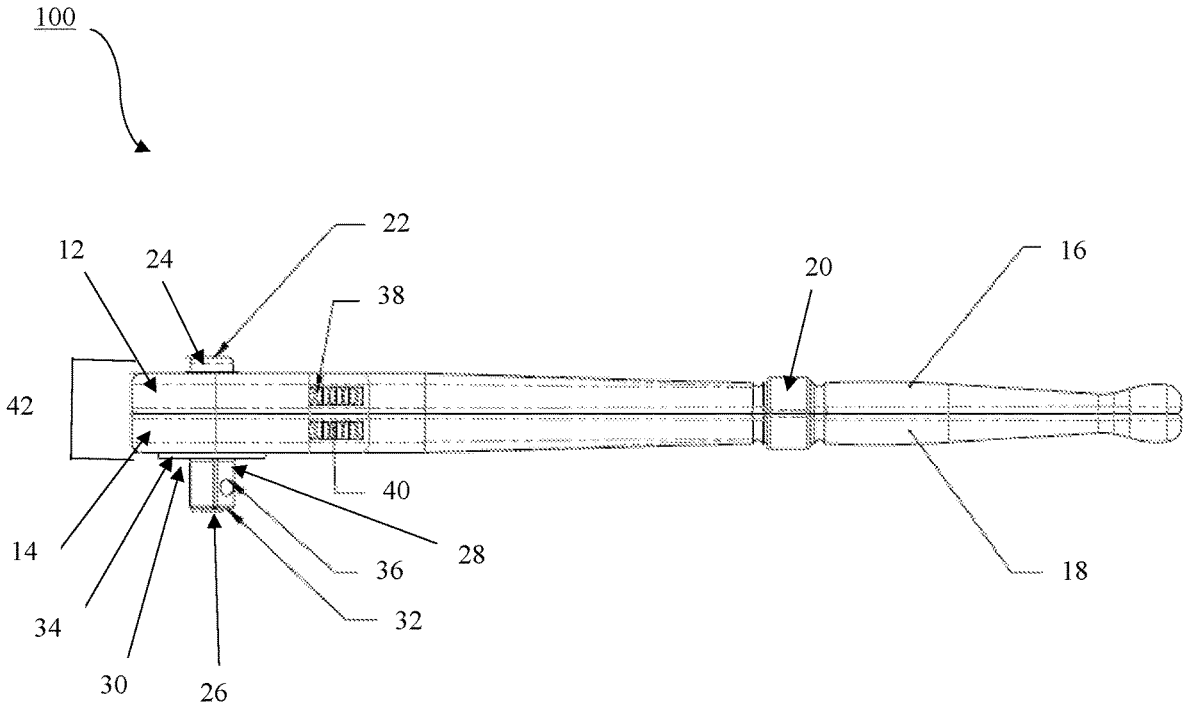
FIG. 1 is a side view of a dual ratcheting tool having a dual ratcheting assembly according to an exemplary embodiment of the present disclosure.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Spatially relative terms, such as "under," "below," "lower," "over," "upper," and the like, may be used herein for ease of description to describe one element or feature's relationship to another when the apparatus is right side up as shown in the accompanying drawings.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The present disclosure provides a dual ratcheting tool having multiple ratchet assemblies and handles for rotating adapters, sockets, allen keys, and fasteners such as screws, nuts, and bolts. Through the use of the alternating motion of the multiple handles, a user can advantageously drive adapters, sockets, allen keys, and fasteners more quickly and efficiently than ratchets having a single ratchet assembly and handle. The multiple handles on the dual ratcheting tool of the present disclosure are also advantageous in that the user can hold steady and start the drive of the fastener without having to physically hold the fastener. The additional handle provides the minimal resistance required so that the ratchet does not spin backwards when there is no friction or torque on the fastener (like traditional ratchets). Moreover, the dual ratcheting tool of the present disclosure provides for the dual handles to be positioned at varying angles, which allows for the user to have support from any direction or side of the dual ratcheting tool.

Figure 2A:
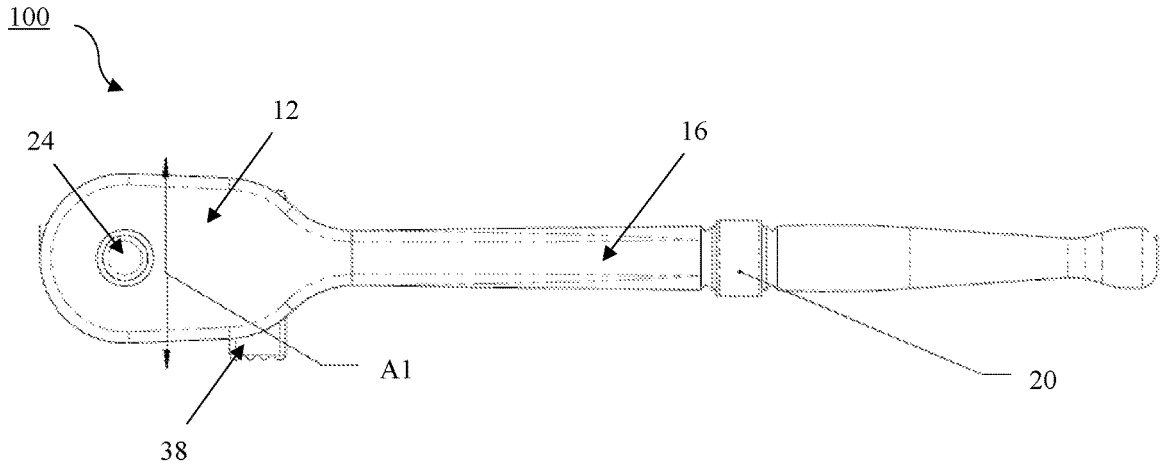
FIG. 2A is a top view of the dual ratcheting tool shown in FIG. 1.
Figure 2B:
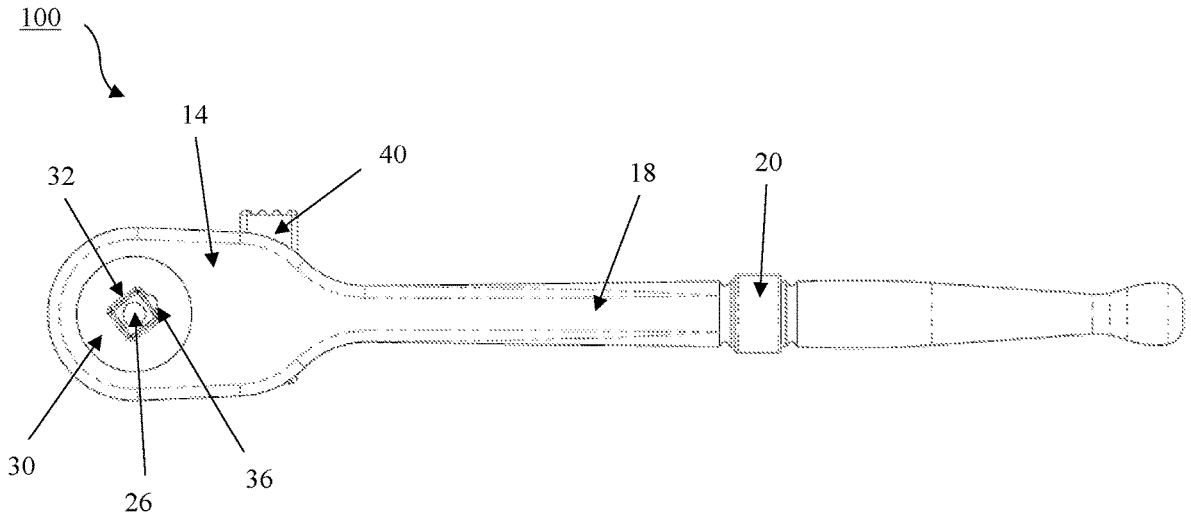
FIG. 2B is a bottom view of the dual ratcheting tool shown in FIG. 1.

Referring to FIGS. 1, 2A, and 2B, a dual ratcheting tool 100 according to an exemplary embodiment of the present disclosure is shown. In the illustrated embodiment, the dual ratcheting tool 100 includes a stacked main dual ratcheting assembly 42 comprised of an upper ratchet assembly 12 operatively connected to a lower ratchet assembly 14. The upper ratchet assembly 12 is operatively connected to the lower ratchet assembly 14 such that each of the upper ratchet assembly 12 and the lower ratchet assembly 14 can move and rotate independently of the other. The upper ratchet assembly 12 and the lower ratchet assembly 14 are operatively attached to an upper handle 16 and a lower handle 18, respectively, in a stacked configuration, as shown in FIG. 1. In one embodiment, the upper handle 16 and the lower handle 18 may be held together by a hinged clasp 20. In this embodiment, the hinged clasp 20 allows for the upper ratchet assembly 12 and the lower ratchet assembly 14 to be used together as a single tool. In other embodiments, as will be described in detail below, the hinged clasp 20 may be opened to allow for the upper ratchet assembly 12 and the lower ratchet assembly 14 to be used independently of each other.

A drive member 28 is provided including a cylindrical portion 30 for attachment to the lower ratchet assembly 14 and a drive portion 32 configured for receiving an attachment (not shown), such as a socket, adapter, or allen key. The upper edge of the cylindrical portion 30 has a flange 34 which rests on and rotates upon an annular inset (not shown) in a bottom portion of the lower ratchet assembly 14. The drive portion 32 may be secured to the cylindrical portion 30 by any suitable fastener so long as the drive portion 32 is free to rotate along the vertical axis. In the illustrated embodiment, the drive portion 32 is a chamfered square drive. The drive portion 32 may be adapted for use with any ANSI SAE or metric socket drive sizes.

In one embodiment, the upper ratchet assembly 12 and the lower ratchet assembly 14, when in the stacked configuration, have a cylindrical aperture (not shown) formed therethrough centered on the vertical axis. A spring-loaded plunger 22 extends vertically within the cylindrical aperture and is operatively attached to a socket retaining ball 36. The socket retaining ball 36 is configured for holding the attachment, such as a socket, to the drive portion 32. The spring-loaded plunger 22 has a first end comprised of a button 24 that is accessible from a top portion of the upper ratchet assembly 12 and is configured to release the attachment when attached to the drive portion 32. The spring-loaded plunger 22 extends vertically through the drive portion 32 to a second end comprised of an outlet 26 within the drive portion 32. As will be discussed in more detail below, when the button 24 of the spring-loaded plunger 22 is pressed, the outlet 26 moves in a vertical downward direction, which in turn releases the socket retaining ball 36 inwardly such that the attachment can be removed from the drive portion 32.

The upper ratchet assembly 12 and the lower ratchet assembly 14 each include a directional switch for selectively controlling the ratcheting or driving rotation of the upper handle 16, the lower handle 18, or both, in a clockwise or counterclockwise direction about the axis relative to the drive member 28. As will be explained in more detail below, the directional switch can also be selectively positioned to lock the upper handle 16 and the lower handle 18 in a specific configuration. As illustrated in FIG. 1, the upper handle 16 includes an upper directional switch 38 to set a drive direction of the upper ratchet assembly 12. The lower handle 18 includes a lower directional switch 40 to set a drive direction of the lower ratchet assembly 14. The upper directional switch 38 and the lower directional switch 40 can operate independently of each other when the upper handle 16 and the lower handle 18 are spaced apart, or together when the upper handle 16 and the lower handle 18 are in a stacked configuration.

As shown by the arrow A1 in FIG. 2A, the upper directional switch 38 and the lower directional switch 40 are configured to slide horizontally from side to side based on the user's choice of ratcheting or driving action, for instance, clockwise or counterclockwise ratcheting or driving. The upper directional switch 38 and the lower directional switch 40 can be moved to the left or right depending on whether the socket is to be turned clockwise to tighten a fastener or counterclockwise to loosen the fastener. The upper directional switch 38 and the lower directional switch 40 can also slide to a middle position for use in locking the upper handle 16 and the lower handle 18. In some embodiments, the upper directional switch 38 and the lower directional switch 40 are positioned in close proximity to each other such that both the upper directional switch 38 and the lower directional switch 40 can operate together with a single push in either direction. In other embodiments, the upper directional switch 38 and the lower directional switch 40 may be configured to slide in a vertical direction. For instance, the upper directional switch 38 and the lower directional switch 40 can slide up and down to change the direction of the ratcheting or driving action.

Figure 3A:
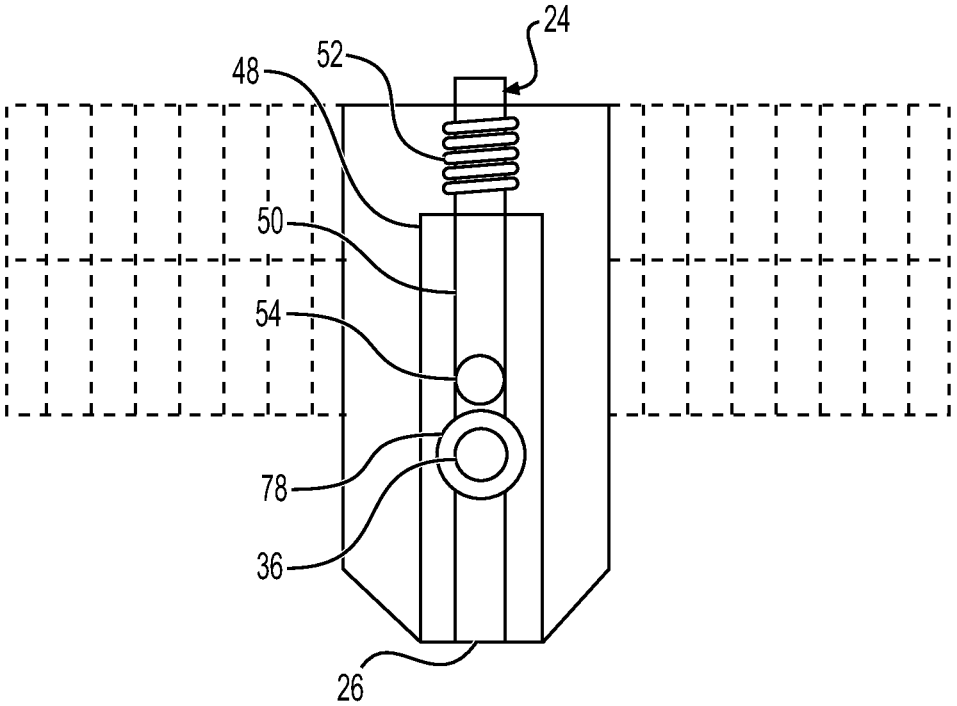
FIG. 3A is a cutaway view of the dual ratcheting assembly illustrating a spring-loaded plunger for releasing a socket retaining ball according to one embodiment of the present disclosure.
Figure 3B:
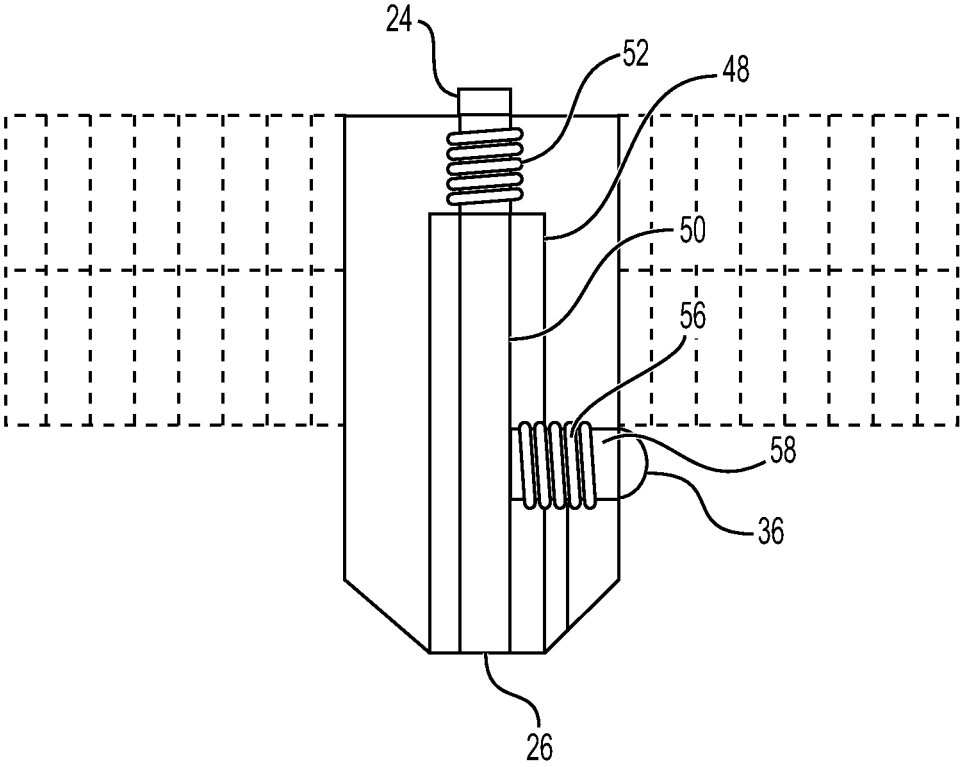
FIG. 3B is another cutaway view of the dual ratcheting assembly illustrating the spring-loaded plunger according to one embodiment of the present disclosure.

FIGS. 3A and 3B are cutaway views of the main dual ratcheting assembly 42 showing the spring-loaded plunger 22 for releasing the socket retaining ball 36. As shown in FIGS. 3A and 3B, the spring-loaded plunger 22 is located within a cylindrical aperture 48 formed through the upper ratchet assembly 12 and the lower ratchet assembly 14. The button 24 of the spring-loaded plunger 22 is operatively attached to a rod 50 vertically extending through the cylindrical aperture 48 and down to the outlet 26. The rod 50 includes a spring 52 operatively connected to the button 24 for attachment release, such as socket release. As shown in FIG. 3A, the rod 50 further includes a cutout 54 for supporting the socket retaining ball 36 during release of the attachment.

As illustrated in FIG. 3B, the socket retaining ball 36 is supported within a bore 58 that extends through a wall of the drive portion 32. The socket retaining ball 36 is resiliently biased by a spring 56 that keeps the socket retaining ball 36 extended outward to hold the attachments, such as the sockets. The socket retaining ball 36 may also include a retaining ring 78 configured for holding the socket retaining ball 36 and the spring 56 attached thereto within the drive portion 32. When the button on the spring-loaded plunger 22 is pressed, the spring-loaded plunger 22 moves the rod 50 in a downward direction, which in turn moves the cutout 54 in a downward direction so that the cutout 54 may align with the bore 58. As the cutout 54 aligns with the bore 58, the spring 56 relaxes and the socket retaining ball 36 moves inwardly and is supported within the cutout 54 such that the attachment can be released from the drive portion 32.

Figure 4:
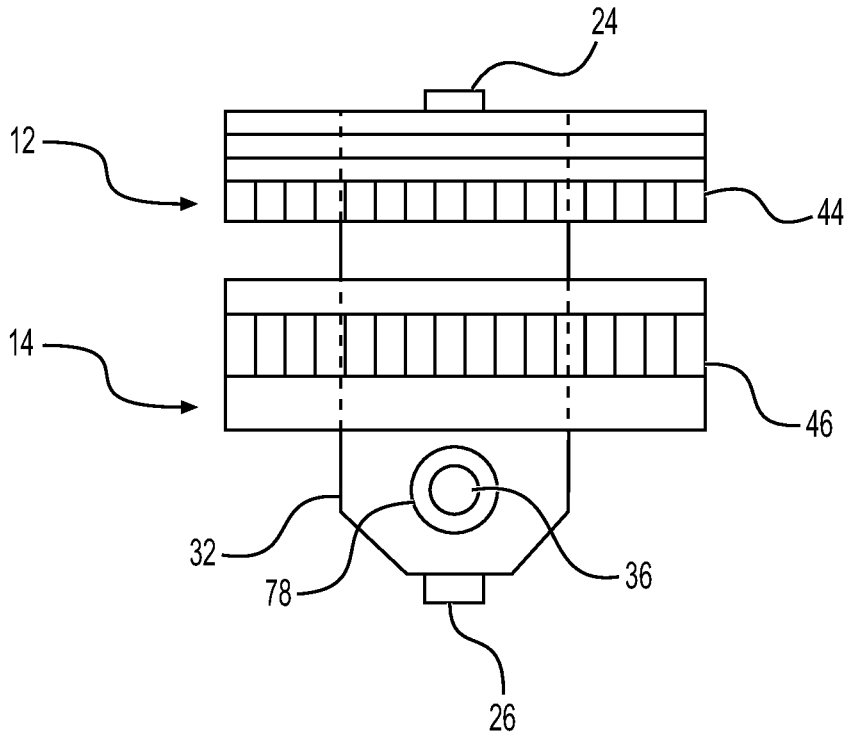
FIG. 4 a cutaway view of the dual ratcheting assembly illustrating internal gear drives according to one embodiment of the present disclosure.

FIG. 4 is a side cutaway view of the main dual ratcheting assembly 42 showing internal gear drives used on the upper ratchet assembly 12 and the lower ratchet assembly 14. As shown in FIG. 4, the upper ratchet assembly 12 includes an upper gear drive 44 and the lower ratchet assembly 14 includes a lower gear drive 46. In one embodiment, the upper gear drive 44 and the lower gear drive 46 are mechanically affixed within the upper ratchet assembly 12 and the lower ratchet assembly 14, respectively. For example, the upper gear drive 44 and the lower gear drive 46 may be welded, soldered, glued, or mechanically keyed.

Figure 5:
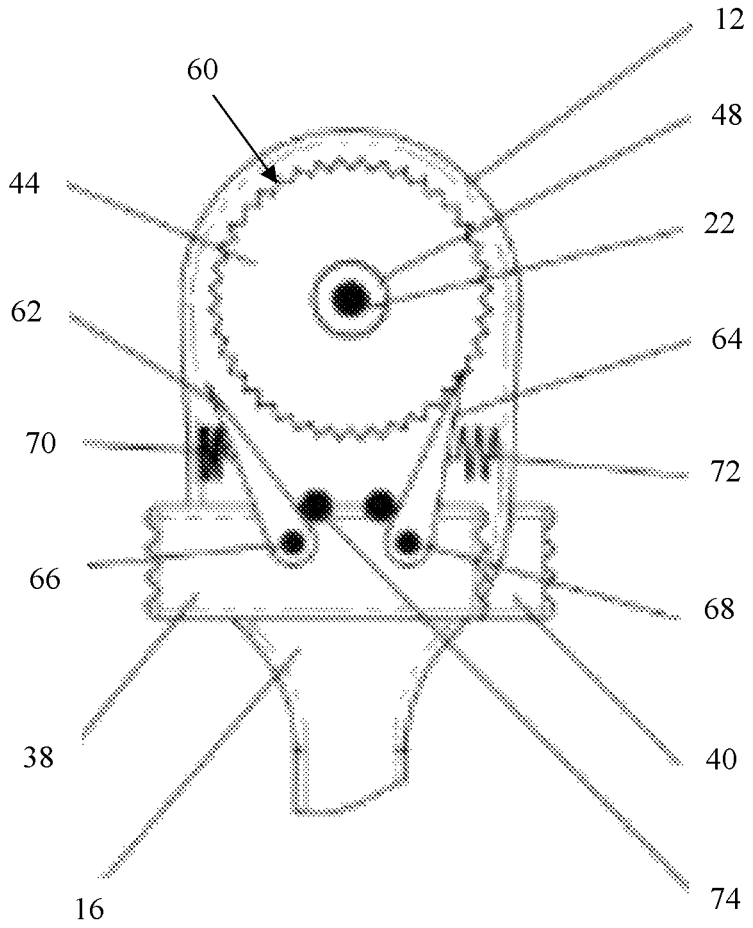
FIG. 5 is a cutaway view of an upper ratchet assembly according to one embodiment of the present disclosure.

FIG. 5 is a top cutaway view of the upper ratchet assembly 12. As illustrated in FIG. 5, the spring-loaded plunger 22 is located within the cylindrical aperture 48 formed through the center of the upper gear drive 44 of the upper ratchet assembly 12. The upper gear drive 44 is comprised of gear teeth 60 extending uniformly about the periphery thereof. A pair of pawls, including a first pawl 62 and a second pawl 64, are adapted for engagement with the gear teeth 60. The first pawl 62 and the second pawl 62 are disposed on opposite sides of the upper gear drive 44 and formed as mirror images of each other. The first pawl 62 includes a first hinge 66 and the second pawl 64 includes a second hinge 68. The first hinge 66 and the second hinge 68 allow each of the pawls 62, 64 to swing in and out of engagement with the gear teeth 60. As shown in FIG. 5, each of the first pawl 62 and the second pawl 64 are also operatively attached to a pair of springs. The first pawl 62 is operatively attached to a first spring 70 and the second pawl 64 is operatively attached to a second spring 72. The first spring 70 and the second spring 72 allow for spring-biased movement of each of the pawls 62, 64 for engaging the upper gear drive 44.

In the illustrated embodiment, each of the first pawl 62 and the second pawl 64 is operatively connected to the upper directional switch 38 such that the placement of the upper directional switch 38 can control the engagement of either the first pawl 62 or the second pawl 64 with the gear teeth 60. The upper directional switch 38 may include a retaining pin 74 operatively attached thereto. The retaining pin 74 is configured to retain either the first pawl 62 or the second pawl 64 from engaging with the upper gear drive 44 or lower gear drive 46.

As shown in FIG. 5, the first pawl 62 is disengaged from the upper gear drive 44, while the second pawl 64 is engaged with the upper gear drive 44. Based on the positioning of the upper directional switch 38, the retaining pin 74 is configured to retain the first pawl 62 against the first spring 70 to prevent the first pawl 62 from engaging with the gear teeth 60. This allows for the second spring 72 to push the second pawl 64 onto the upper gear drive 44 so that the second pawl 64 can engage the gear teeth 60. In this embodiment, the upper directional switch 38 allows for counterclockwise driving and clockwise ratcheting action via the second pawl 64.

For example, the second pawl 64, shown engaged with the upper gear drive 44, allows for a user to ratchet the upper ratchet assembly 12 (using the upper handle 16) in a clockwise direction without turning or engaging the upper gear drive 44. When the upper handle 16 is turned in a counterclockwise direction however, the second pawl 64 engages with the upper gear drive 44 to provide counterclockwise driving action of the main dual ratcheting assembly 42.

When the upper directional switch 38 is moved to the opposite side, the retaining pin 74 releases the first pawl 62 and retains the second pawl 64. When the first pawl 62 is no longer retained by the retaining pin 74, the first spring 70 pushes the first pawl 62 toward the upper gear drive 44, which allows for the first pawl 62 to engage the upper gear drive 44. In this embodiment, the upper directional switch 38 allows for clockwise driving and counterclockwise ratcheting action via the first pawl 62. The first pawl 62, when engaged with the upper gear drive 44, allows for a user to ratchet the upper ratchet assembly 12 (using the upper handle 16) in a counterclockwise direction without turning or engaging the upper gear drive 44. When the upper handle 16 is turned in a clockwise direction however, the first pawl 62 engages the upper gear drive 44 to provide clockwise driving action of the main dual ratcheting assembly 42. While the main dual ratcheting assembly 42 has been described as utilizing dual pawls and directional switches, other pawl and switch mechanisms, such as a single pawl, may be used with the dual ratcheting assembly 42 of the present disclosure so long as the mechanisms allow for the dual ratcheting and driving action provided herein.

Figure 6:
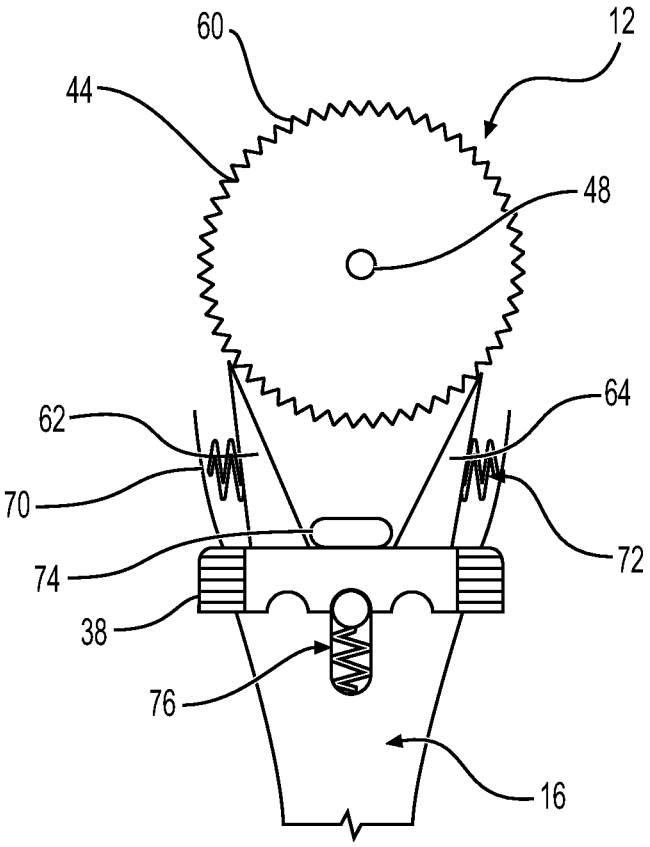
FIG. 6 is a cutaway view of the upper ratchet assembly according to another embodiment of the present disclosure.

FIG. 6 is a top cutaway view of the upper ratchet assembly 12 according to another embodiment. As illustrated in FIG. 6, the upper directional switch 38 may be configured to slide to a middle position on the upper handle 16. The middle position is defined as a position halfway between the outermost left position and the outermost right position. When the upper directional switch 38 is moved to the middle position, the retaining pin 74 is released from either the first pawl 62 and the second pawl 64, which allows for both the first pawl 62 and the second pawl 64 to engage the upper gear drive 44. This configuration locks all ratcheting and driving motion on either or both of the upper handle 16 and the lower handle 18 so that any clockwise or counterclockwise operation from either or both of the handles 16, 18 translates directly into output movement.

In some embodiments, as shown in FIG. 6, the upper directional switch 38 and the lower directional switch 40 may further include a retaining ball and spring 76 to maintain the desired positioning of the upper directional switch 38 and the lower directional switch 40. In this embodiment, the retaining ball and spring 76 allows for the retaining ball to be held in one of three indentations on the upper directional switch 38 and/or the lower directional switch 40: a left indentation for positioning the upper or lower directional switch 38, 40 for clockwise ratcheting, a middle indentation for positioning the upper or lower directional switch 38, 40 in a locked position, and a right indentation for positioning the upper or lower directional switch 38, 40 for counterclockwise ratcheting. When the retaining ball is engaged in the indentation, the retaining ball maintains the desired positioning of the upper or lower directional switch 38, 40. While FIGS. 5 and 6 illustrate the components and operation of the upper ratcheting assembly 12, as will be apparent to one of ordinary skill in the art, the lower ratcheting assembly 14 may include identical components as the upper ratcheting assembly 12 and operate in a similar manner as explained above.

Figure 7A:
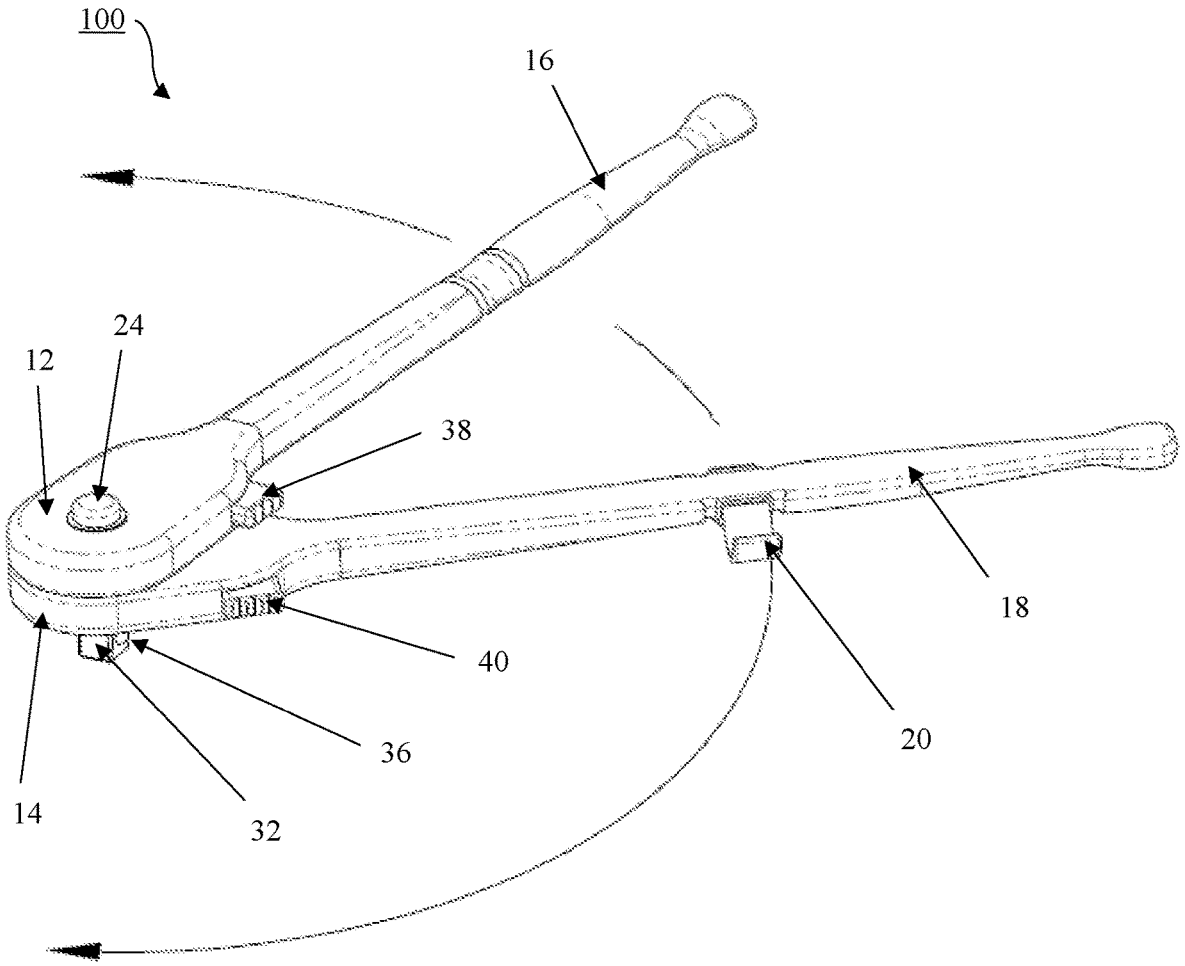
FIG. 7A is a perspective view of the dual ratcheting tool according to one embodiment of the present disclosure.
Figure 7B:
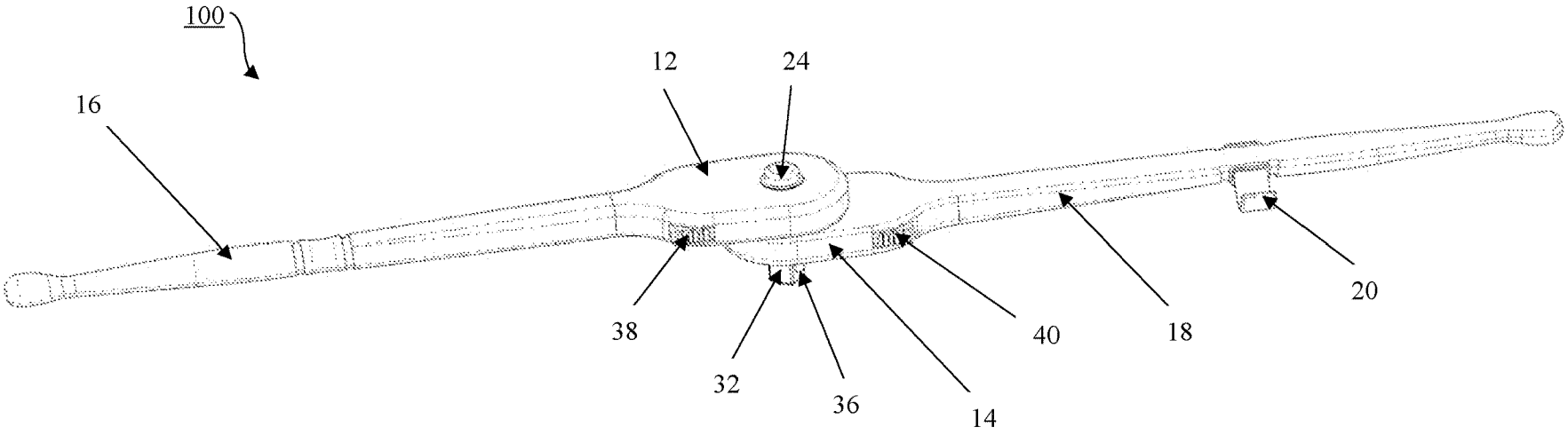
FIG. 7B is a perspective view of the dual ratcheting tool according to another embodiment of the present disclosure.

FIGS. 7A and 7B are perspective views of the dual ratcheting tool 100 showing the rotational movement of the upper handle 16 and the lower handle 18. As demonstrated by the arrows shown in FIG. 7A, the upper handle 16 and the lower handle 18 can move independently of each other. For example, the upper handle 16 can be rotated in a counterclockwise direction, while the lower handle 18 can be rotated in a clockwise direction. The dual use of the handles 16, 18 advantageously allows for the user to drive sockets, adapters, and other fasteners more quickly and efficiently than prior ratcheting tools since both handles 16, 18 drive and ratchet in the same direction with alternating motion. In some embodiments, the dual use of the handles 16, 18 advantageously allows for the user to drive the sockets, adapters, and other fasteners twice as fast as prior ratcheting tools. FIG. 7B shows the lower handle 18 rotated to an angle of 180 degrees from the upper handle 16 such that the upper handle 16 and the lower handle 18 are in a linear configuration. When the handles 16, 18 are positioned 180 degrees apart, the handles 16, 18 provide for increased torque, for instance, at least two times the torque, for driving the sockets, adapters, and other fasteners. As described above, the handles 16, 18 can be locked in the 180-degree configuration shown in FIG. 7B by selectively positioning the upper directional switch 38 and the lower directional switch 40 in the middle position such that both the first pawl 62 and the second pawl 64 are engaged with the upper gear drive 44 and the lower gear drive 46. In other embodiments, the upper handle 16 and the lower handle 18 are each independently rotatable in a clockwise or counterclockwise direction 360 degrees about the vertical axis of the dual ratcheting assembly 42.

In some embodiments, the dual ratcheting tool 100 having dual handles (i.e., the upper handle 16 and the lower handle 18) can also be used as a torque wrench. In this embodiment, the main dual ratcheting assembly 42 on the dual ratcheting tool 100 may be replaced with a torque wrench. The torque wrench of the present disclosure can be used in lieu of the traditional arm of a bar or click-type torque wrench. Advantageously, the torque wrench is fully housed in the driving head of the dual ratcheting tool 100 and can be used with smaller tools or multi-armed tools.

Figure 8A:
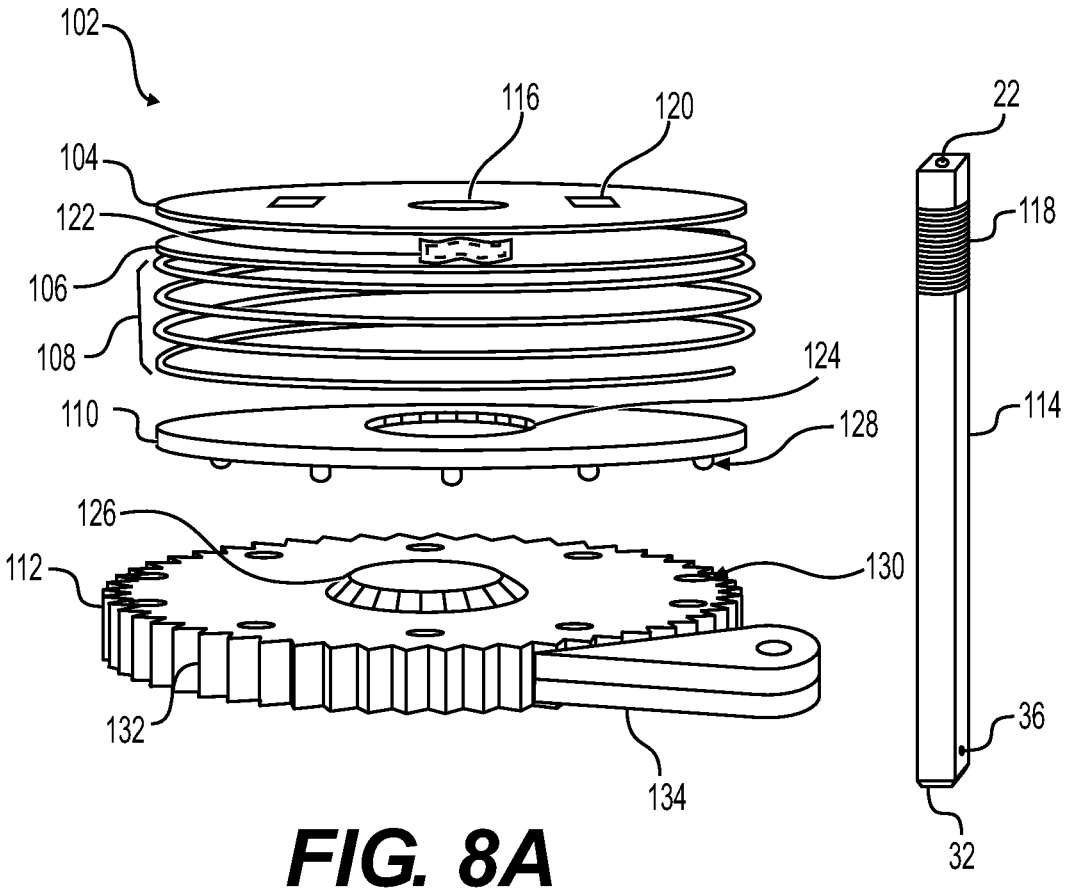
FIG. 8A is an exploded view of a torque wrench assembly according to an exemplary embodiment of the present disclosure.
Figure 8B:
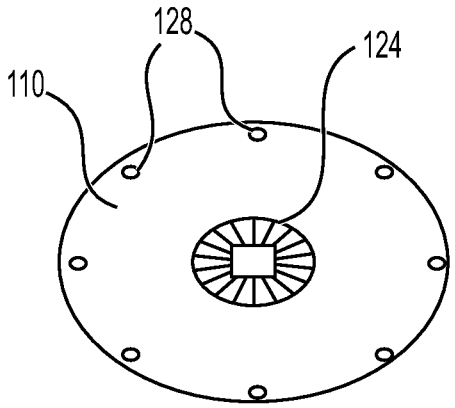
FIGS. 8B and 8C are top views of components of the torque wrench assembly shown in FIG. 8A.
Figure 8C:
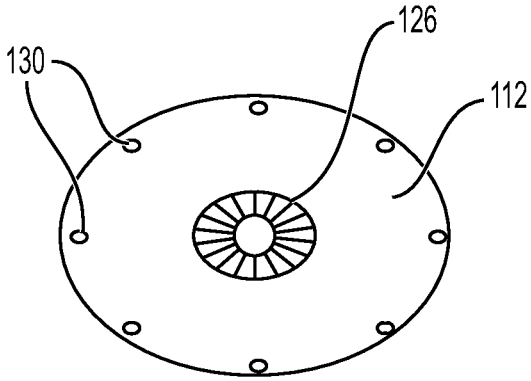

FIGS. 8A-8C are exploded views of a torque wrench assembly 102 adapted for use with the dual ratcheting tool 100 according to an exemplary embodiment of the present disclosure. As shown in FIG. 8A, the torque wrench assembly 102 is comprised of a top plate 104, a floating plate 106 disposed thereunder, a spring 108, and a bottom plate 110 operatively connected to a gear drive 112. Each of the top plate 104, the floating plate 106, the spring 108, the bottom plate 110 and the gear drive 112 are configured to be received on a shaft 114. In one embodiment, the shaft 114 is configured to house the spring-loaded plunger 22 and the socket retaining ball 36 for holding sockets or other tools on the drive portion 32, as described above with respect to FIGS. 1-4.

The top plate 104 includes a threaded opening 116 for engagement with threading 118 on the shaft 114. The threaded engagement allows for the top plate 104 to move up and down the shaft 114 as it is rotated. The threading 118 can be sized to correspond to an appropriate spring rate of the spring 108. For instance, the sizing of the threading 118 may be selected by one of ordinary skill in the art based on the particular use and the necessary torque requirements. In some embodiments, the top plate 104 may include one or more tabs 120 to assist the user in rotating the top plate 104 about the threading 118 on the shaft 114. Like the top plate 104, the floating plate 106 disposed thereunder is configured to move up and down between the top plate 104 and the spring 108. The floating plate 106 may include an opening 122 for receiving the shaft 114. In one embodiment, the opening 122 is complementary in shape to the cross-sectional shape of the shaft 114. For example, the opening 122 may be square shaped to match the square shaped cross-sectional profile of the shaft 114. The complementary shape allows for the floating plate 106 to transfer the torque to the shaft 114.

The spring 108 is biased between the floating plate 106 and the bottom plate 110 and is configured to receive the shaft 114. However, in some embodiments, the spring 108 does not engage directly with the shaft 114. The spring 108 is configured to be compressed as the top plate 104 moves down the threading 118 on the shaft 114. This, in turn, exerts force onto the bottom plate 110 and subsequently the gear drive 112, allowing the torque wrench assembly 102 to limit the amount of torque translated to the shaft 114.

The bottom plate 110 is disposed under the spring 108 and is operatively attached to the gear drive 112. In the illustrated embodiment, the bottom plate 110 is comprised of a bevel gear 124 that is configured to engage with a corresponding bevel gear 126 on the gear drive 112 (as shown in FIGS. 8B and 8C). In other embodiments, non-bevel type gears may be utilized with the bottom plate 110 and the gear drive 112, such as concentric or interlocking gears. The bottom plate 110 also has a bottom surface (as depicted in FIG. 8A) comprised of a plurality of roller bearings 128. The roller bearings 128 are configured to seat against corresponding roller seats 130 on a top surface of the gear drive 112. The roller bearings 128 may be seated against a surface portion of the corresponding roller seats 130. In some embodiments, with enough torque applied to the torque wrench assembly 102, the roller bearings 128 are configured to rotate to an adjacent corresponding roller seat 130.

In the illustrated embodiment, the gear drive 112 is comprised of gear teeth 132 extending uniformly about the periphery thereof. A pair of pawls 134 are adapted for engagement with the gear teeth 132. The pawls 134 are disposed on opposite sides of the gear drive 112 and formed as mirror images of each other. The pawls 134 are configured to engage the gear teeth 132 when driving the gear drive 112. While the use of a single gear drive has been exemplified, it will be readily apparent to those skilled in the art that more than one gear drive, for instance, a dual gear drive, may be utilized with the torque wrench assembly 102 described herein. For example, the dual gear drive described above with respect to the dual ratcheting tool 100 may be utilized with the torque wrench assembly 102.

In operation, a user can turn the tabs 120 to rotate the top plate 104. The top plate 104 rotates about the threading 118 on the shaft 114, which compresses the spring 108 down against the bottom plate 110. As the spring 108 is compressed downward, the roller bearings 128 and the bevel gear 124 on the bottom plate 110 mate with the corresponding roller seats 130 and the corresponding bevel gear 126 on the gear drive 112. The greater the spring 108 is compressed, the greater the pressure that is placed from bottom plate 100 onto the gear drive 112. As the user exerts force on the torque wrench assembly 102 via the upper handle 16, the bottom handle 18, or both, the pawls 134 engage with the gear drive 112. As torque is placed on the gear drive 112, the torque is translated through the corresponding roller seats 130 and the corresponding bevel gear 126, up through the roller bearings 128 and the bevel gear 124, via the spring 108, to the top plate 104. The top plate 104 then translates the force to the shaft 114, which translates the force down through the torque wrench assembly 102 and onto the drive portion 32 holding the socket or other attachment tool.

Figure 9:
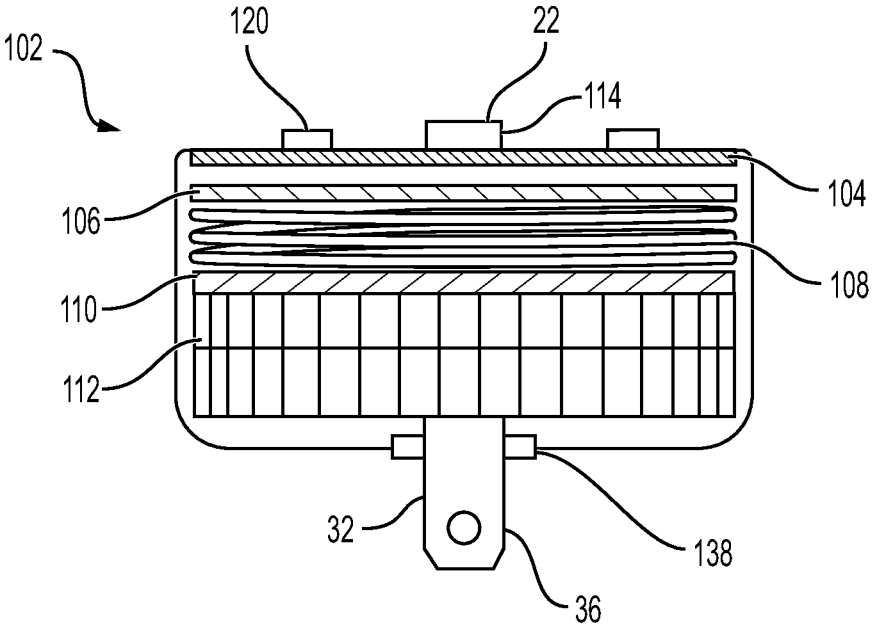
FIG. 9 is a cutaway view of the torque wrench assembly as assembled.

FIG. 9 shows a cutaway view of the torque wrench assembly 102. As shown in FIG. 9, the top plate 104, the floating plate 106, the spring 108, the bottom plate 110, and the gear drive 112 are operatively connected to the shaft 114 within a casing 136. The shaft 114 extends vertically through each of the floating plate 106, the spring 108, the bottom plate 110, and the gear drive 112. The button 24 for the spring-loaded plunger 22 is accessible from a top end of the shaft 114. The tabs 120 extend from the top plate 104 and are also accessible to the user. A bottom end of the shaft 114 houses the drive portion 32 and the socket retaining ball 36 for attachment to sockets or other tools. In some embodiments, the shaft 114 may include a shaft retaining ring 138 positioned on the bottom of the casing 136 for holding the shaft 114 in place and sealing the casing 136.

Figure 10:
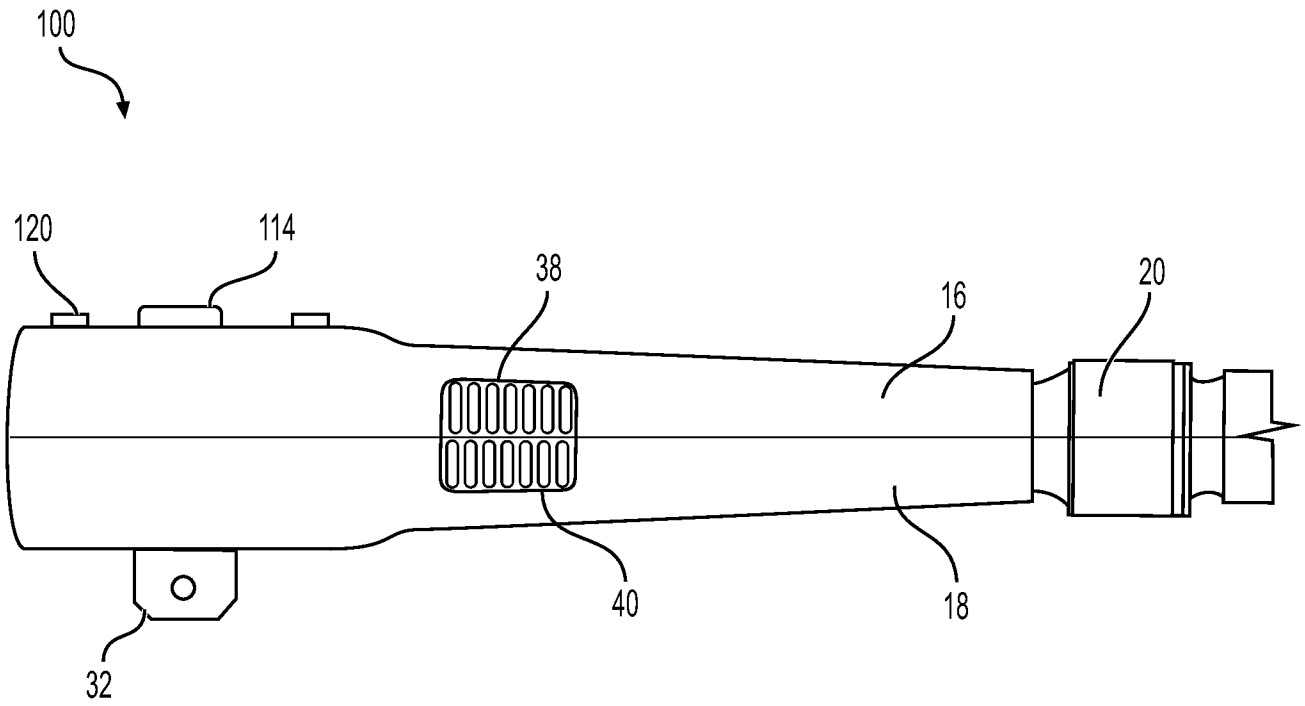
FIG. 10 is a side view of the dual ratcheting tool having the torque wrench assembly assembled therein according to an exemplary embodiment of the present disclosure.

FIG. 10 is a side view of the torque wrench assembly 102 housed within the dual ratcheting tool 100. As shown in FIG. 10, the torque wrench assembly 102 can be adapted for use with the dual ratcheting tool 100. In this embodiment, the torque wrench assembly 102 can be operated with the dual handles, i.e., the upper handle 16 and the lower handle 18. The upper directional switch 38 and the lower directional switch 40 can also be adapted for use with the torque wrench assembly 102.

Figure 11A:
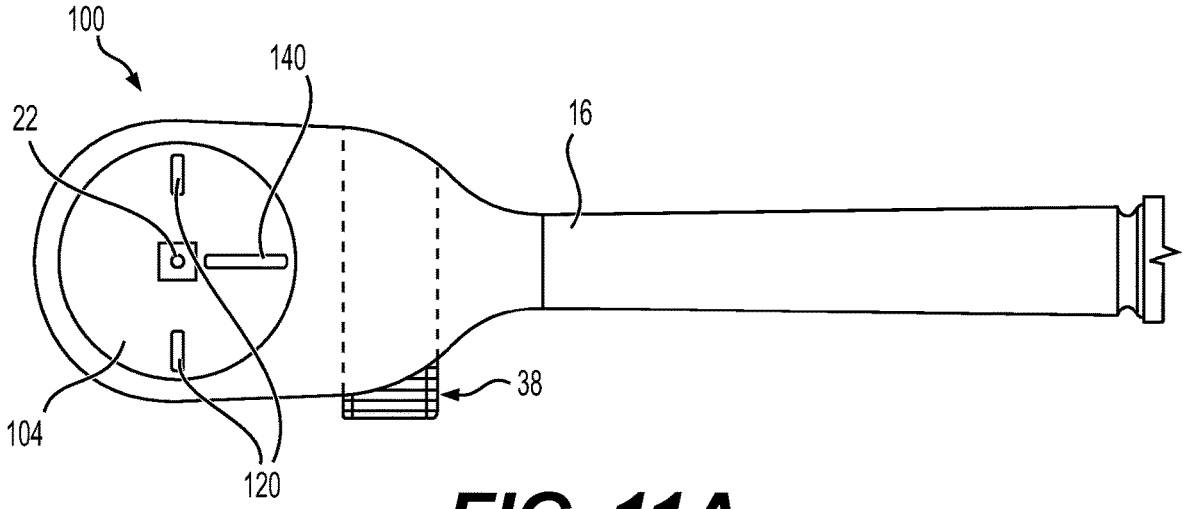
FIG. 11A is a top view of the dual ratcheting tool having the torque wrench assembly assembled therein according to one embodiment of the present disclosure.
Figure 11B:
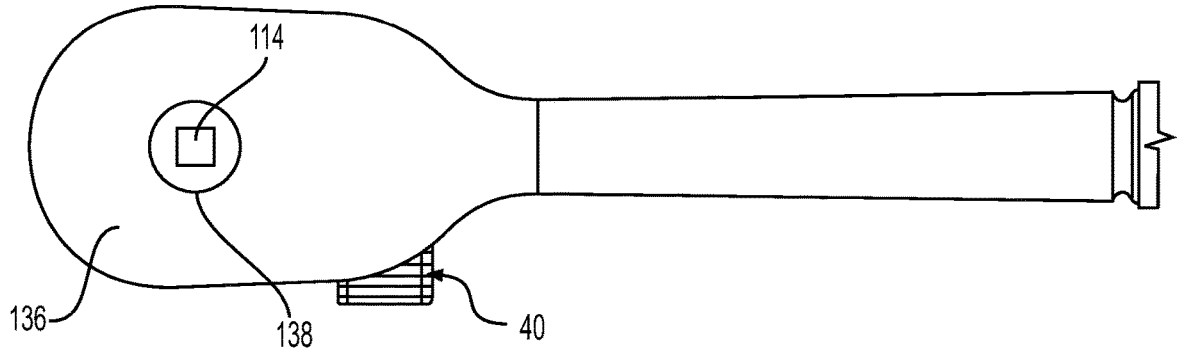
FIG. 11B is a bottom view of the dual ratcheting tool having the torque wrench assembly assembled therein according to one embodiment of the present disclosure.

FIGS. 11A and 11B are top and bottom views of the torque wrench assembly 102 housed within the dual ratcheting tool 100. As shown in FIG. 11A, the top plate 10 may include an elongated slot 140 for viewing a torque setting on the floating plate 106 disposed thereunder, as will be explained in more detail below. FIG. 11B shows the bottom of the shaft 114 and the shaft retaining ring 138 positioned on the casing 136. The shaft retaining ring 138 is configured to seal the bottom of the casing 136 to hold the shaft 114 in place and allow for rotation of the shaft 114. In one embodiment, the shaft retaining ring 138 is circular in shape and is comprised of an inner, square-shaped hole sized for receiving the shaft 114. Though as will be apparent to those of ordinary skill in the art, the shaft retaining ring 138 may have any size or shape so long as the shaft retaining ring 138 allows for rotation of the shaft 114 and provides for a secure attachment to the casing 136.

Figure 12A:
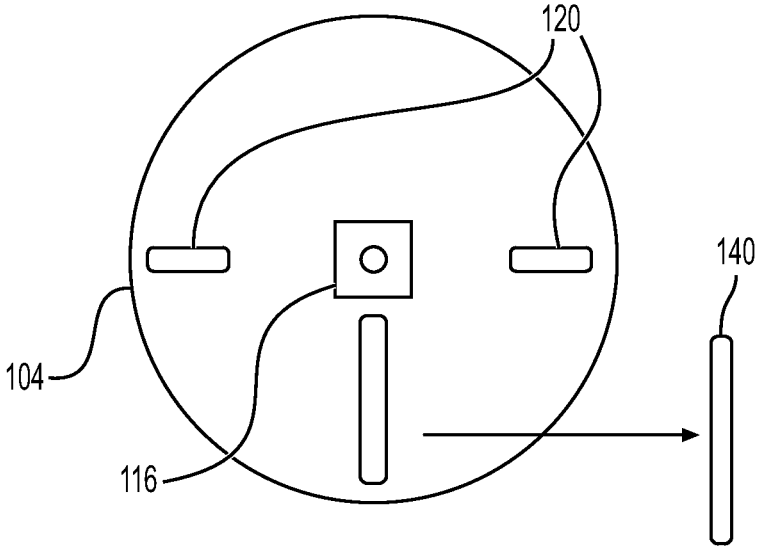
FIG. 12A is a top view of a top plate in the torque wrench assembly according to one embodiment of the present disclosure.
Figure 12B:
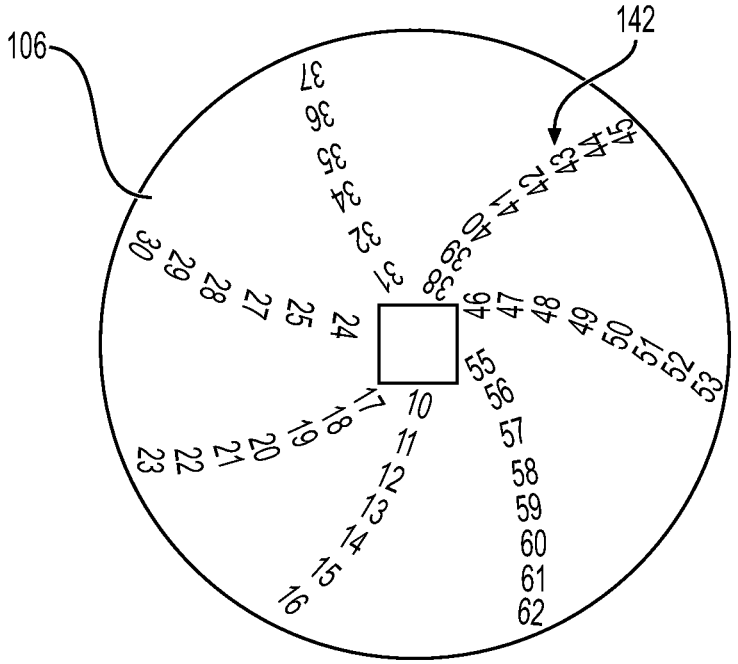
FIG. 12B is a top view of a floating plate in the torque wrench assembly according to one embodiment of the present disclosure.
Figure 13A:
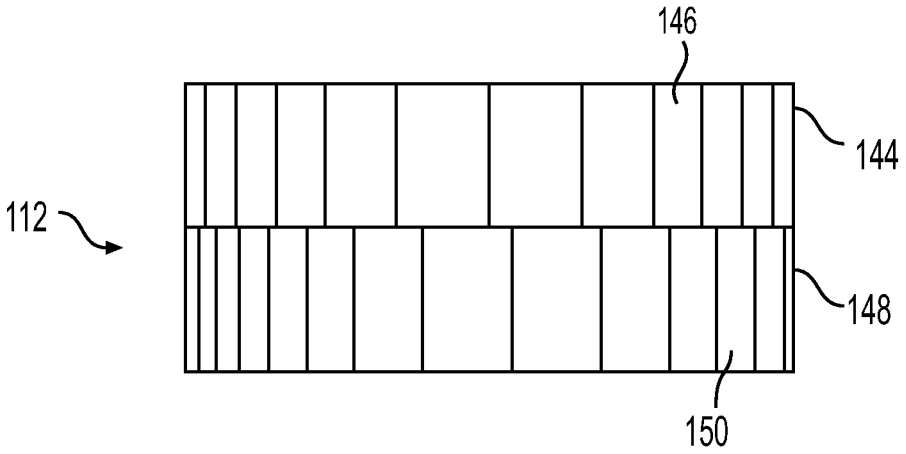
FIG. 13A is a side view of the gear drives in the torque wrench assembly according to one embodiment of the present disclosure.
Figure 13B:
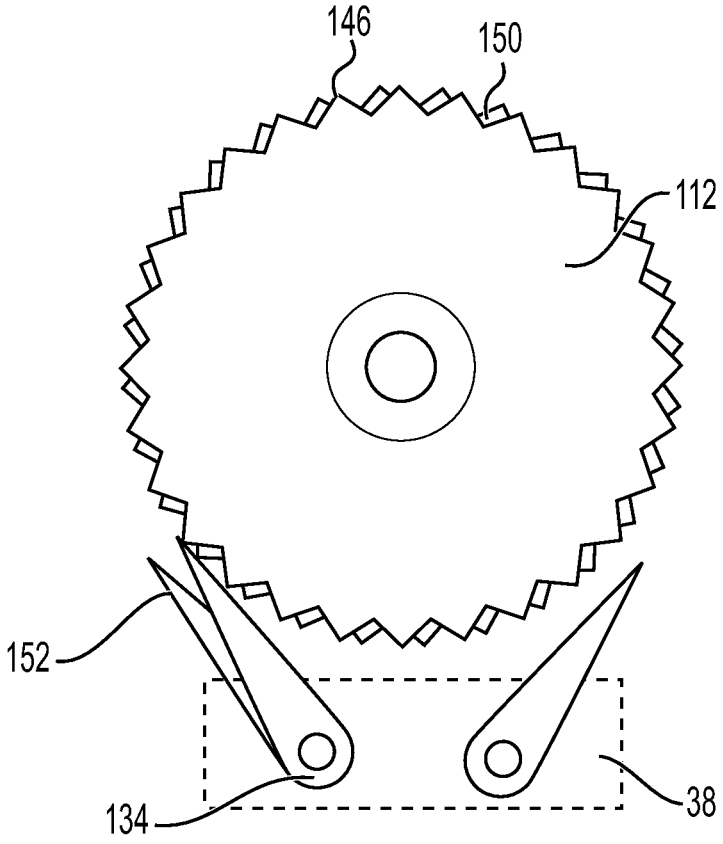
FIG. 13B is a top view of the gear drives in the torque wrench assembly according to one embodiment of the present disclosure.

FIGS. 12A and 12B are top views of the top plate 104 and the floating plate 106, respectively. In some embodiments, a user may desire to select a specific torque setting before use. In this embodiment, the floating plate 106 may include a plurality of torque settings 142 so that a user can select and adjust the desired torque setting. The torque settings 142 can be displayed on a top surface of the floating plate 106, as illustrated in FIG. 12B. When the top plate 104 is assembled over the floating plate 106, the elongated slot 140 in the top plate 104 can be used to view and select the desired torque setting 142 on the floating plate 106 disposed thereunder. In one embodiment, the top plate 104 can be rotated, using tabs 120, to align the elongated slot 140 with the desired torque setting 142 on the floating plate 106. Once the desired torque setting 142 is selected, the torque setting 142 is translated through to the shaft 114. In this embodiment, the torque wrench assembly 102 is advantageous in that it allows for measurement of torque at the shaft 114 of rotation (as opposed to the handle), which allows multiple handles to exert measurable force and to limit the torque from a single or multiple handles. The torque settings 142 may vary depending on the spring rate and the range of the spring 108. In another embodiment, the elongated slot 140 may be designed to include a window (not shown) that allows for a single torque setting 142 to be viewed and selected, while blocking the other torque settings 142 displayed on the floating plate 106. In this embodiment, the window may be slidably configured to move up and down within the elongated slot 140 to display the desired torque setting FIGS. 13A and 13B are side and top views, respectively, of the gear drive 112 according to another embodiment of the present disclosure. In this embodiment, the gear drive 112 may include two sets of gears, for instance, an upper gear 144 and a lower gear 148, having an alternating gear tooth arrangement. As shown in FIGS. 13A and 13B, the gear teeth 146 on the upper gear 144 may be positioned such that the gear teeth 146 alternate with the gear teeth 150 on the lower gear 148. In other words, the gear teeth 146 on the upper gear 144 do not align with the gear teeth 150 on the lower gear 148. Each of the upper gear 144 and the lower gear 148 may include a set of pawls as described above for engagement with the gear teeth 146, 150. For example, the upper gear 144 may include the pawls 134 and the lower gear 148 may include a set of pawls 152. The alternating gear tooth arrangement described herein advantageously allows for an increase in the number of gear teeth and positions for the handle to ratchet, which creates a more precise tool by reducing the amount of travel required to ratchet back between teeth and pawl engagement. While the alternating gear tooth arrangement has been described with respect to the gear drive 112 of the torque wrench assembly 102, it will be readily apparent to one of ordinary skill in the art that a similar alternating gear tooth arrangement may be utilized for the gear teeth 60 of the upper gear drive 44 and the lower gear drive 46 on the main dual ratcheting assembly 42. The alternating gear tooth arrangement described herein can also be utilized with both a dual handle operation and a single handle operation.

Figure 14A:
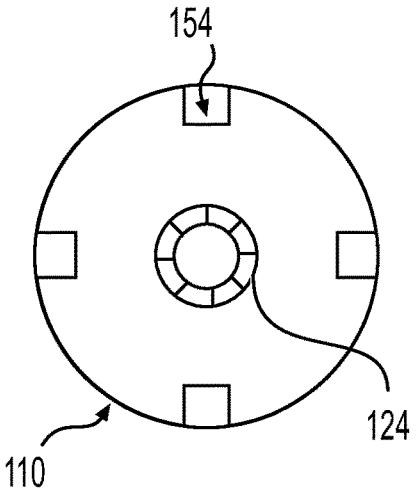
FIG. 14A is a top view of a bottom plate in the torque wrench assembly according to another embodiment of the present disclosure.
Figure 14B:
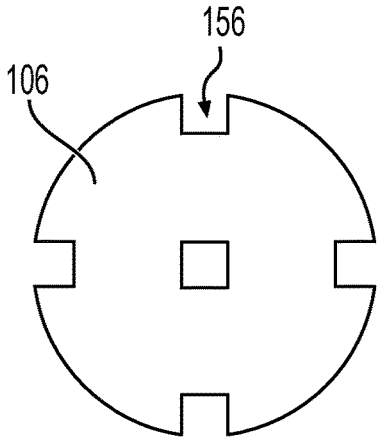
FIG. 14B is a top view of the floating plate in the torque wrench assembly according to another embodiment of the present disclosure.
Figure 14C:
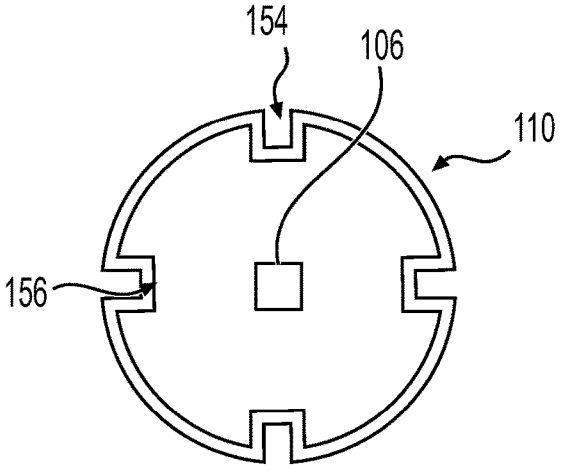
FIG. 14C is a top view of the bottom plate and the floating plate in the torque wrench assembly according to an embodiment of the present disclosure.
Figure 14D:
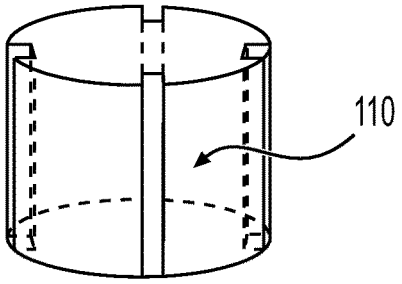
FIG. 14D is a side view of the bottom plate in the torque wrench assembly according to one embodiment of the present disclosure.
Figure 14E:
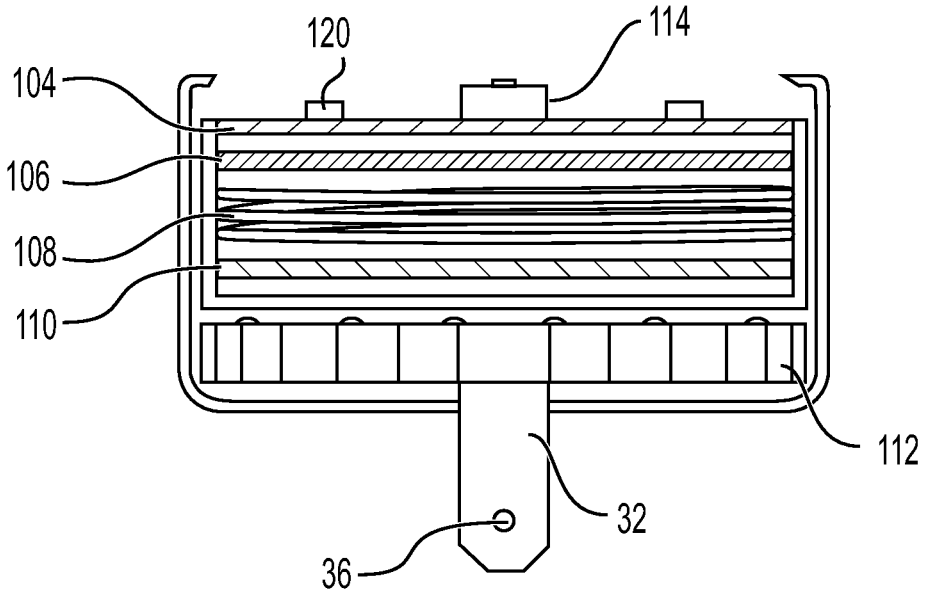
FIG. 14E is a cutaway view of the torque wrench assembly as assembled according to another embodiment of the present disclosure.

FIGS. 14A-14E show the floating plate 106 and the bottom plate 110 according to an alternative embodiment of the present disclosure. In this embodiment, the bottom plate 110 may include a plurality of grooves 154, as shown in FIG. 14A. The grooves 154 may be symmetrically disposed equidistant apart along the periphery of the bottom plate 110. The floating plate 106 may have a plurality of opposing grooves 156 that correspond to the grooves 154 on the bottom plate 110 (as illustrated in FIGS. 14B and 14C). The plurality of opposing grooves 156 on the floating plate 106 allows for the torque to be transferred from the bottom plate 110 to the floating plate 106 without changing the amount of torque on the spring 108. In this embodiment, as shown in FIG. 14D, the bottom plate 110 may be cup-shaped to allow for the top plate 104, the floating plate 106, and the spring 108 to be received therein. FIG. 14E shows a cutaway view of the torque wrench assembly 102 having the cup-shaped bottom plate 110 shown in FIG. 14D. In operation, as the top plate 104 rotates, the top plate 104 and the spring 108 can rotate vertically within the cup-shaped bottom plate 110, while the floating plate 106 moves vertically upward and downward (without rotating) due to the opposing grooves 156. This allows for the force to be directly translated onto the shaft 114 via the rigid grooves in lieu of spring torque and tension. In some embodiments, this design makes it easier to service and replace the components within the torque wrench assembly 102.

Figure 15:
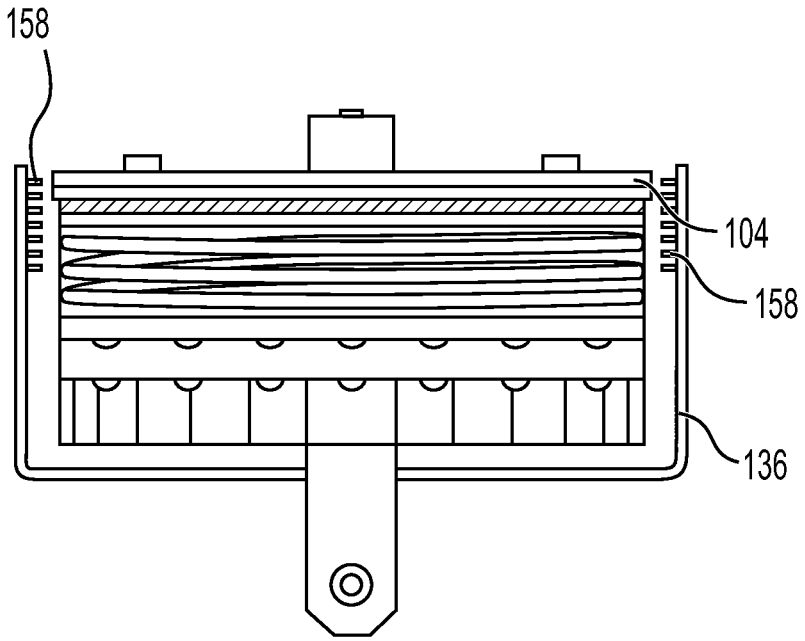
FIG. 15 is a cutaway view of the torque wrench assembly according to still another embodiment of the present disclosure.

FIG. 15 shows the torque wrench assembly 102 according to still another embodiment of the present disclosure. As shown in FIG. 15, rather than the shaft 114 including the threading 118, the casing 136 can include threading 158 directly thereon for engagement with the top plate 104. In this embodiment, the top plate 104 may include threading on an outer periphery thereof for direct attachment and engagement with threading 158 on an inner surface of the casing 136.

The various components of the dual ratcheting tool 100 described herein may be constructed or manufactured from materials, such as various polymers, plastics, stainless steel, aluminum, and combinations thereof. Similarly, the various parts described herein may be constructed according to various manufacturing methods including injection molding, milling, forging, extrusion, pressing, 3D printing, and other related manufacturing methods.

The devices described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the devices in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the inventions set forth herein.

What is claimed is:

1. A dual ratcheting tool, comprising:

a stacked ratchet assembly, the stacked ratchet assembly comprising an upper ratchet assembly operatively connected to a lower ratchet assembly;

a drive member operatively connected to the upper ratchet assembly and the lower ratchet assembly, wherein the drive member further comprises a spring-loaded ball configured for retaining an attachment thereto;

an upper handle connected to the upper ratchet assembly, the upper handle having an upper directional switch to set or lock a drive direction of the upper ratchet assembly;

a lower handle connected to the lower ratchet assembly, the lower handle having a lower directional switch to set or lock a drive direction of the lower ratchet assembly;

a plunger slidably positioned through the stacked ratchet assembly having a first end extending from the upper ratchet assembly and a second end positioned through the lower ratchet assembly and said drive member, wherein the plunger is configured to release the spring-loaded ball holding the attachment thereto;

wherein the upper ratchet assembly comprises an upper gear drive configured for rotation by the upper handle and the lower ratchet assembly comprises a lower gear drive configured for rotation by the lower handle, the upper gear drive and the lower gear drive each comprise a plurality of gear teeth configured for engagement with a pawl; and wherein the upper handle and the lower handle independently and in combination drive the attachment.

2. The dual ratcheting tool of claim 1, wherein the upper directional switch and the lower directional switch are configured to slide horizontally to set each of the drive directions.

3. The dual ratcheting tool of claim 1, wherein the upper directional switch and the lower directional switch are further configured to set a locking position in which the rotational movement of the upper handle, the lower handle, or both the upper handle and the lower handle is locked.

4. The dual ratcheting tool of claim 1, wherein the first end of the plunger comprises a button operable to release the spring-loaded ball.

5. The dual ratcheting tool of claim 1, wherein the upper handle and the lower handle are each rotatable 360 degrees about a vertical axis of the stacked ratchet assembly.

6. The dual ratcheting tool of claim 1, wherein the upper directional switch is positioned adjacent to and directly above the lower directional switch.

7. The dual ratcheting tool of claim 1, wherein the attachment comprises a socket, adapter, allen key, allen wrench, nut, bolt, or bit.

8. The dual ratcheting tool of claim 1, wherein the pawl is operatively connected to a spring, the spring configured to move the pawl into engagement with the gear teeth when the drive direction is set.

9. The dual ratcheting tool of claim 1, wherein the drive member is a male drive member or a female drive member.

10. A torque wrench, comprising:

a torque wrench assembly having a top plate, a spring disposed in between the top plate and a bottom plate, wherein the bottom plate is configured for engagement with an upper gear drive and a lower gear drive, and wherein the top plate, the bottom plate, and the upper and lower gear drives are operatively attached to a shaft;

a drive member operatively connected to the shaft, wherein the drive member is configured for retaining an attachment thereto;

an upper handle connected to the torque wrench assembly, the upper handle having an upper directional switch to set or lock a drive direction of the upper gear drive;

a lower handle connected to the torque wrench assembly, the lower handle having a lower directional switch to set or lock a drive direction of the lower gear drive;

wherein the upper handle and the lower handle independently and in combination drive the attachment.

11. The torque wrench of claim 10, wherein the upper gear drive and the lower gear drive comprise bevel gears, concentric gears, interlocking gears, or combinations thereof.

12. The torque wrench of claim 10, wherein the top plate comprises a threaded opening configured for coupling to a corresponding threaded portion on the shaft.

13. The torque wrench of claim 10, wherein the bottom plate comprises a plurality of roller bearings configured for engagement with a plurality of corresponding roller seats disposed on the upper gear drive.

14. The torque wrench of claim 10, wherein the attachment comprises a socket, adapter, allen key, allen wrench, nut, bolt, or bit.

* * * * *